US007267182B2

(12) United States Patent
Saha

(10) Patent No.: US 7,267,182 B2
(45) Date of Patent: Sep. 11, 2007

(54) ROCK DRILLING RIG AND ROCK BREAKING MACHINE

(75) Inventor: Heikki Saha, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 10/824,606

(22) Filed: Apr. 15, 2004

(65) Prior Publication Data

US 2004/0194985 A1 Oct. 7, 2004

Related U.S. Application Data

(63) Continuation of application No. PCT/FI02/00812, filed on Oct. 18, 2002.

(30) Foreign Application Priority Data

Oct. 19, 2001 (FI) ..... 20012035

(51) Int. Cl.
*E21B 1/00* (2006.01)

(52) U.S. Cl. ..... 173/2; 173/11; 173/141

(58) Field of Classification Search ..... 173/2, 173/11, 141; 175/24
See application file for complete search history.

(56) References Cited

U.S. PATENT DOCUMENTS

| | | | | | |
|---|---|---|---|---|---|
| 4,230,189 | A | * | 10/1980 | Mashimo | 173/4 |
| 4,343,367 | A | * | 8/1982 | Mashimo | 173/190 |
| 4,698,570 | A | * | 10/1987 | Satoh | 318/568.19 |
| 4,804,051 | A | * | 2/1989 | Ho | 175/26 |
| 5,383,524 | A | * | 1/1995 | Rinnemaa | 173/1 |
| 5,560,437 | A | * | 10/1996 | Dickel et al. | 175/40 |
| 5,699,261 | A | | 12/1997 | Muona | |
| 5,812,068 | A | | 9/1998 | Wisler et al. | |
| 5,934,387 | A | * | 8/1999 | Tuunanen | 175/45 |
| 6,026,911 | A | * | 2/2000 | Angle et al. | 175/24 |

* cited by examiner

*Primary Examiner*—Thanh Truong
(74) *Attorney, Agent, or Firm*—Drinker Biddle & Reath LLP

(57) ABSTRACT

The rock drilling rig comprises a first control unit (8) arranged on a carrier (1) and a second control unit (9) arranged to a rock drilling apparatus (4). The first control unit (8) and the second control unit (9) communicate with each other by means of a first data communications link (10). The rock drilling apparatus (4) has one or more sensors (11, 12, 15), the measuring results of which are processed in the second control unit (9) and only then transmitted to the first control unit (8) that controls actuators regulating the operation of the rock drilling apparatus (4). Correspondingly, the rock breaking machine, such as a breaking hammer, comprises one or more sensors (11, 12, 15) and a control unit (9).

5 Claims, 2 Drawing Sheets

ROCK DRILLING RIG AND ROCK BREAKING MACHINE

CROSS-REFERENCE TO RELATED APPLICATIONS

This application is a continuation of PCT/FI02/00812, filed on Oct. 18, 2002.

BACKGROUND OF THE INVENTION

The invention relates to a rock drilling rig comprising a carrier, feeding beam, rock drilling apparatus movable in relation to the feeding beam and having a percussion device, one or more sensors arranged to the rock drilling apparatus to monitor the operation of the rock drilling apparatus, and further at least one first control unit arranged on the carrier of the rock drilling rig to control the operation of the rock drilling apparatus on the basis of measuring information received from the sensors.

The invention further relates to a rock breaking machine comprising a body, percussion device arranged inside the body to generate impact pulses to a tool connectable to the rock breaking machine, and one or more sensors arranged to monitor the operation of the apparatus.

In prior art rock drilling rigs, the operation of the rock drilling apparatus is controlled by a control unit arranged on the carrier of the rock drilling rig typically on a control deck. It is further known to equip a rock drilling apparatus with one or more sensors to monitor the operation of the drilling apparatus during use. Information received from the sensors is transmitted as such over a one-way channel to the control unit on the carrier of the rock drilling rig, which on the basis of the measuring information and parameters entered into the control unit forms the control commands required for drilling control. A rock drilling apparatus is usually hydraulic, which means that in practice it is controlled by adjusting valves arranged in hydraulic channels leading to the drilling apparatus. Normally, the valves are on the carrier. A drawback of the known rock drilling rigs is that the control unit is far away from the rock drilling apparatus. This means that the relatively weak measuring signal received from the sensors arranged in the drilling apparatus is easily disturbed, which reduces measuring accuracy. Thus, it is difficult to control the drill accurately on the basis of the received measuring information. Some measurements are not even worth making due to the long distance between the sensors and the control unit.

BRIEF DESCRIPTION OF THE INVENTION

It is an object of the present invention to provide a novel and improved rock drilling rig and rock breaking machine.

The rock drilling rig of the invention is characterized in that the rock drilling rig comprises a second control unit arranged to the rock drilling apparatus and a data communications link between the first control unit and the second control unit for transmitting information between the control units, that the sensors monitoring the operation of the rock drilling apparatus are connected to transmit measuring information to the second control unit, that the second control unit comprises a memory unit for storing basic settings for the drilling apparatus and a processing unit for calculating parameters describing the operating state of the rock drilling apparatus on the basis of said basic settings and measuring information, and that the first control unit is arranged to control the operation of the rock drilling apparatus on the basis of the parameters received from the second control unit and instructions given to the first control unit.

Further, the rock breaking machine of the invention is characterized in that the rock breaking machine has a control unit, that said sensors are arranged to transmit measuring information to the control unit, that the control unit comprises a memory unit for storing basic settings for the rock breaking machine and further a processing unit that is, during operation, arranged to form parameters describing the operating state of the rock breaking machine on the basis of the basic settings and measuring information, and that the control unit comprises an connection to a data communications link that enables communication between the control unit and at least one unit external to the rock breaking machine.

The essential idea of the invention is that for controlling drilling, a first control unit is arranged on the carrier of the rock drilling rig and a second control unit is arranged to the rock drilling apparatus. Said control units communicate with each other using a data communications link arranged between them. One or more sensors are arranged to the drilling apparatus to monitor the operation of the drilling apparatus during drilling. Measuring results received from the sensors are transmitted to the second control unit that comprises a memory unit and processing unit. The basic settings of the drilling apparatus can be stored in the memory unit. The processing unit is in turn arranged to calculate parameters describing the operating state of the drilling apparatus on the basis of the measuring information received from the sensors and the basic settings stored in the memory unit. From the second control unit, the parameters are transmitted to the first control unit arranged on the carrier of the drilling rig that controls the actuators affecting the operation of the drilling apparatus, such as valves or electric regulating elements, on the basis of the parameters and control commands given to the second control unit so as to achieve the desired operating state of the drilling apparatus. Because the prevailing operating state of the drilling apparatus is defined already in the drilling apparatus, the control unit arranged on the carrier can be a relatively simple one. At its simplest, the first control unit is a control element, by means of which the desired drilling values are entered into the control system. Because the equipment for defining the operating state of an individual drilling apparatus, i.e. the sensors and second control unit, is arranged to the drilling apparatus, the replacement of the entire drilling apparatus or a later modification of the original drilling apparatus is simple and does not cause difficult changes to the control system in the rock drilling rig.

The essential idea of an embodiment of the invention is that the second control unit is arranged inside the rock drilling apparatus where it is protected from dents and ambient conditions. In addition, at least some of the sensors are integrated as part of the control unit so that the control unit and sensors form together a compact entity. Even weak measuring signal received from the sensors can then be received by the second control unit. All in all, the measuring results can thus be made more accurate, which enables an accurate control of the drilling apparatus. Further, this type of control unit is easy to replace, if the control of the drilling apparatus later requires updating.

The essential idea of an embodiment of the invention is that between the first and second control units, there is a CAN (Controller Area Network) bus that also enables a versatile monitoring of the drilling apparatus. Through monitoring, detected and starting defects can efficiently be communicated to the user. The CAN bus has proven a reliable solution in demanding conditions.

The essential idea of an embodiment of the invention is that the second control unit comprises an identifier that the first control unit is arranged to read automatically, whereby the drilling apparatus connected to the rock drilling rig is always explicitly identified. This facilitates the possible replacement of the drilling apparatus.

BRIEF DESCRIPTION OF THE FIGURES

The invention is described in more detail in the attached drawings, in which.

For the sake of clarity, the invention is shown simplified in the figures. The same reference numerals are used for similar parts.

DETAILED DESCRIPTION OF THE INVENTION

Figure 1:
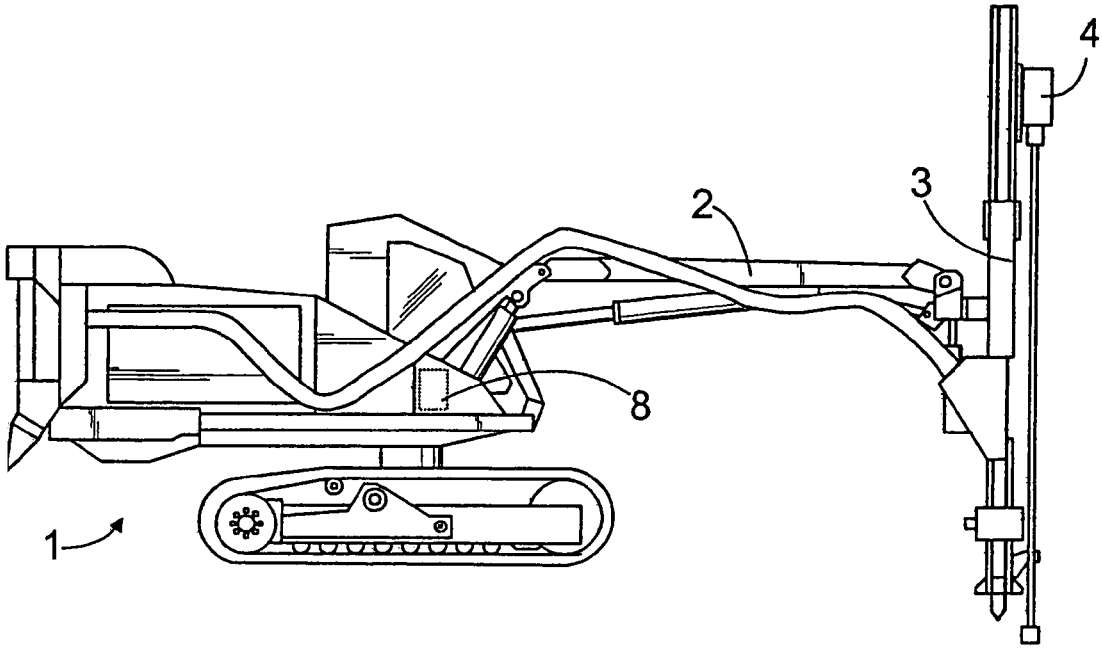
FIG. 1 is a schematic side view of a rock drilling rig of the invention.

The rock drilling rig shown in FIG. 1 comprises a movable carrier 1, a boom 2 arranged movable in relation to the carrier, and a feeding beam 3 arranged to the free end of the boom. In some cases, the feeding beam 3 can be arranged directly on the carrier 1. A rock drilling apparatus 4 can be moved in relation to the feeding beam 3 by means of suitable actuators.

Figure 2:
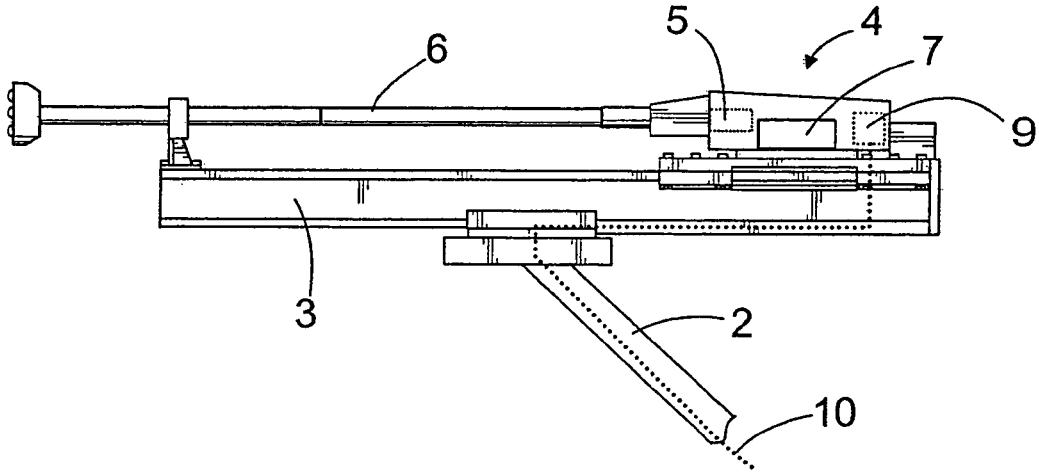
FIG. 2 is a schematic side view of a rock drilling apparatus of the invention.

FIG. 2 shows a rock drilling apparatus 4 comprising a percussion device 5 for providing impact pulses to a tool 6 connected to the drilling apparatus. Further, the rock drilling apparatus usually comprises a rotating device 7 for rotating the tool 6 around its longitudinal axis. Because the general structure and operation of a rock drilling rig and rock drilling apparatus are obvious to a person skilled in the art, they need not be described in more detail in this application.

Figure 3:
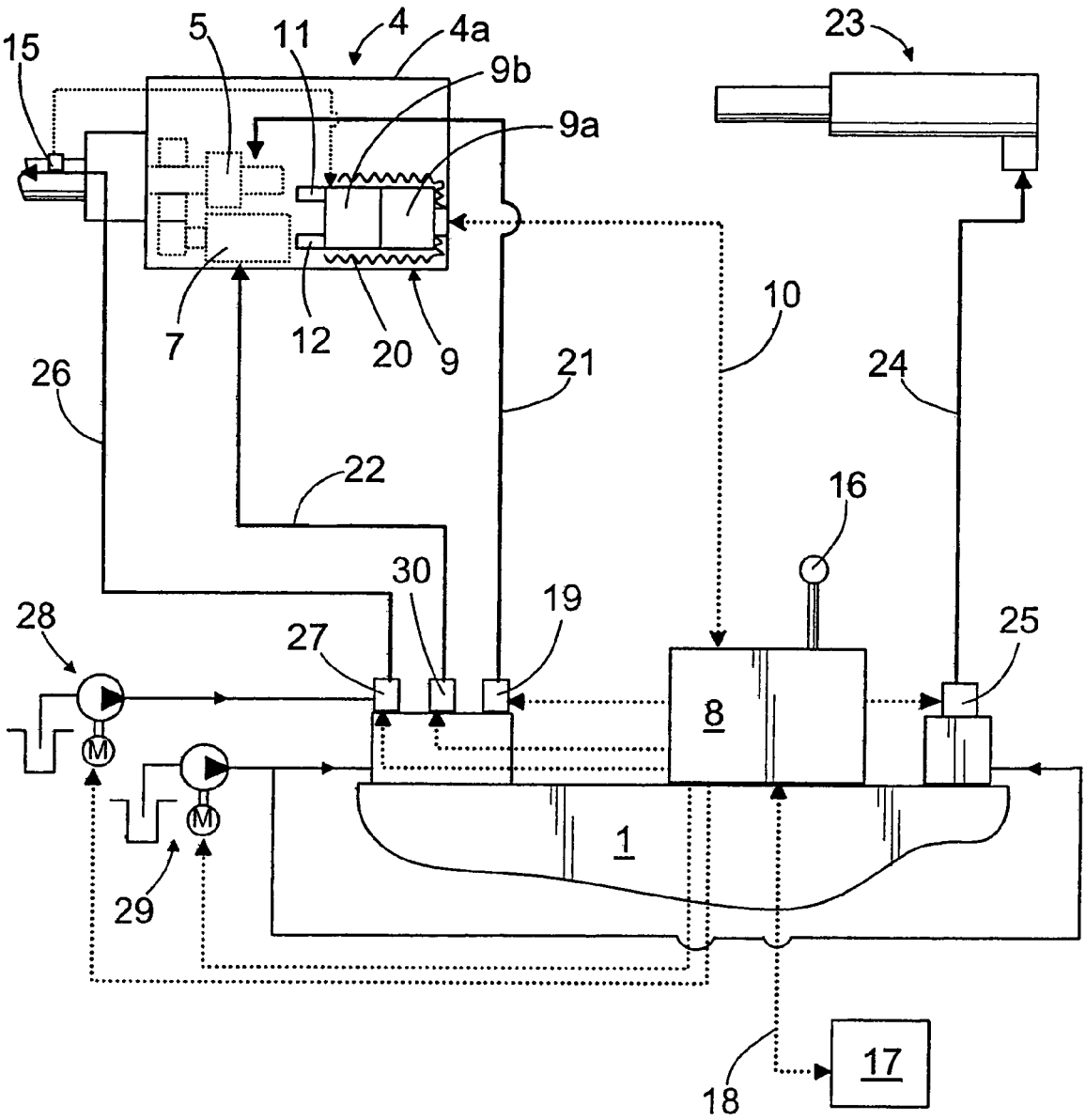
FIG. 3 is a schematic representation of a control system of the invention.

FIG. 3 shows the principle of a control system of the invention. The control system comprises a first control unit 8 arranged on the carrier 1 of the rock drilling rig. Further, the system comprises a second control unit 9 arranged to the rock drilling apparatus 4 or some other rock breaking machine. In this context, a rock breaking machine refers not only to a drilling apparatus, but also to any other apparatus comprising a percussion device, such as a breaking hammer. Between the first control unit 8 and the second control unit 9, there is a data communications link 10, preferably a CAN (Controller Area Network) bus, enabling bi-directional data communication between the control units 8, 9. This way, the control units 8 and 9 may communicate and exchange information with each other. Other suitable fixed data transmission channels may also be applied. In some cases even a wireless link between the control units is possible.

The second control unit 9 may be arranged inside the body 4*a* of the rock drilling apparatus, where it is protected from the ambient conditions and dents. Due to severe operating conditions, it may be advantageous to use surface-mounted devices in the electronic circuits of the control unit 9, because they endure vibration relatively well. The harmful effect of vibration may further be reduced by arranging the entire control unit 9 or at least its most vulnerable components inside a suitable elastic mass 20. The construction and its placement inside the drilling apparatus should also be arranged in such a manner that the control unit 9 does not overheat during operation.

The second control unit 9 comprises a memory unit 9*a* and processing unit 9*b*. The individual basic settings of each drilling apparatus type can be stored in the memory unit 9*a*. The basic settings depend on the construction and size category of the drilling apparatus. The basic settings include information on the impact pressure used in the drilling apparatus, volume flow of the rotating device, volume flow of flushing, feeding pressure, etc. The processing unit 9*b* may comprise a computer, programmable logic or the like able to process the entered information. Further, one or more sensors 11, 12 may be integrated to the second control unit 9. In this case, sensor 11 is arranged to monitor the operation of the percussion device 5 and sensor 12 is arranged to monitor the operation of the rotating device 7. Further, measuring information is transmitted to the second control unit 9 from a separate sensor 15 that is arranged to monitor the feeding of flushing medium.

Control commands and a possible drilling plan may be entered into the first control unit. Drillings plans may be entered manually into the first control unit 8 by using a user interface, such as controller 16, in it, or they may be loaded from an external unit, such as computer or diskette. Further, the first control unit 8 may be connected to a third control unit 17 external to the rock drilling rig 1 through a second data communications link 18. Such a solution may be applied to the control of autonomous rigs, for instance, in which case the third control unit 17 may be arranged in a control room outside the mine, from which the control commands and drilling plans are delivered to the first control unit 8.

In a simplified manner, the control system operates in such a manner that the first control unit 8 informs the second control unit 9 on the basis of the instructions, i.e. the drilling plan and control commands, how the drilling apparatus 4 should operate at each time. After the basic settings of the drilling apparatus and the prevailing situation, i.e. operating state, have been taken into consideration, the second control unit 9 informs the first control unit 8 what external resources it needs to perform the required operation. It is thus a kind of feedback arrangement. In practice, the processing unit 9*b* of the second control unit 9 forms parameters that are transmitted to the first control unit 8 where the parameters are compared with the instructions entered into the first control unit 8. On the basis of the comparison, the first control unit 8 adjusts the actuators affecting the operation of the drilling apparatus 4. In the solution shown in FIG. 3, the first control unit 8 adjusts a first valve 19 that is arranged in a pressure medium channel 21 leading to the percussion device 5. Further, the first control unit 8 adjusts a second valve 30 that is arranged in a pressure medium channel 22 leading to the rotating device 7. A third valve 25 arranged in a channel 24 leading to a feeding cylinder 25 and a fourth valve 27 arranged in a flushing medium channel 26 are adjusted correspondingly. Further, pumps 28 and 29 can also be adjusted. By adjusting the percussion device, rotating device, the feeding and flushing of the drill, for instance, the drilling apparatus may be directed to operate exactly in the desired manner in each situation.

In known solutions, the control system of the rock drilling apparatus is designed for one drilling apparatus type only. A possible later modification of the drilling apparatus or its replacement to a drilling apparatus differing in power or other properties from the original assembly causes massive and expensive changes to the control system of the entire rock drilling rig. Instead, the solution of the invention enables the use of different drilling apparatuses, since the control system may identify the drilling apparatus arranged in the rock drilling rig. The identification information may be stored in the basic settings of the second control unit that the first control unit may read through the data communications link. Alternatively, the second control unit may be equipped with a mechanical detector based on shorted circuits or the like. To facilitate the later replacement of the drilling apparatus, the equipment mounted on the carrier of the rock drilling rig may be dimensioned in such a manner that it is suitable for drilling apparatuses of different sizes.

The drawings and the related description are only intended to illustrate the idea of the invention. The invention may vary in detail within the scope of the claims. Therefore, even though the figures and their description describe an invention for a rock drilling apparatus, the invention can also be applied to other rock breaking machines comprising a percussion device, such as secondary breaking apparatuses. Further, it does not matter to the solution of the invention whether the percussion device is operated by pressure medium, electricity or in some other manner. For instance, in an electrically operated apparatus, electrical quantities are controlled instead of hydraulic valves and pumps.

What is claimed is:

1. A rock drilling rig comprising:

a carrier, at least one feeding beam, a rock drilling apparatus movable in relation to the feeding beam and having a percussion device, one or more sensors arranged to the rock drilling apparatus to measure an operation of the rock drilling apparatus, at least one first control unit arranged on the carrier of the rock drilling rig to control the operation of the rock drilling apparatus on the basis of measuring information received from the sensors, a second control unit arranged to the rock drilling apparatus, a data communications link between the first control unit and the second control unit for transmitting information between the control units, the sensors monitoring the operation of the rock drilling apparatus are connected to transmit measuring information to the second control unit, the second control unit comprises a memory unit for storing basic settings for the rock drilling apparatus and a processing unit for calculating parameters describing an operating state of the rock drilling apparatus on the basis of said basic settings and measuring information, whereby the prevailing operating state of the drilling apparatus is defined in the drilling apparatus, and the first control unit is arranged to control the operation of the rock drilling apparatus on the basis of the parameters received from the second control unit and instructions given to the first control unit.

2. A rock drilling rig as claimed in claim 1, wherein the second control unit is arranged inside the body of the rock drilling apparatus and at least some of the sensors and the second control unit form together a compact entity.

3. A rock drilling rig as claimed in claim 1, wherein the first data communications link between the first control unit and the second control unit is a CAN bus.

4. A rock drilling rig comprising:

a carrier, at least one feeding beam, a rock drilling apparatus movable in relation to the feeding beam and having a percussion device, one or more sensors arranged to the rock drilling apparatus to measure an operation of the rock drilling apparatus, at least one first control unit arranged on the carrier of the rock drilling rig to control the operation of the rock drilling apparatus on the basis of measuring information received from the sensors, a second control unit arranged to the rock drilling apparatus, a data communications link between the first control unit and the second control unit for transmitting information between the control units, the sensors monitoring the operation of the rock drilling apparatus are connected to transmit measuring information to the second control unit, the second control unit comprises a memory unit for storing basic settings for the rock drilling apparatus and a processing unit for calculating parameters describing an operating state of the rock drilling apparatus on the basis of said basic settings and measuring information, the second control unit is arranged to inform the first control unit about external resources that the second control unit needs to perform a required operation, and the first control unit is arranged to adjust actuators affecting the operation of the rock drilling apparatus on the basis of the parameters received from the second control unit and instructions given to the first control unit.

5. A rock drilling rig comprising:

a carrier, at least one feeding beam, a rock drilling apparatus movable in relation to the feeding beam and having a percussion device, one or more sensors arranged to the rock drilling apparatus to measure an operation of the rock drilling apparatus, at least one first control unit arranged on the carrier of the rock drilling rig to control the operation of the rock drilling apparatus on the basis of measuring information received from the sensors, a second control unit arranged to the rock drilling apparatus, a data communications link between the first control unit and the second control unit for transmitting information between the control units, the sensors monitoring the operation of the rock drilling apparatus are connected to transmit measuring information to the second control unit, the second control unit comprises a memory unit for storing basic settings for the rock drilling apparatus and a processing unit for calculating parameters describing an operating state of the rock drilling apparatus on the basis of said basic settings and measuring information, and the first control unit is arranged to control the operation of the rock drilling apparatus on the basis of the parameters received from the second control unit and instructions given to the first control unit, and the first control unit is arranged to adjust a first valve arranged in a pressure medium channel leading from a pump to the percussion device, whereby the first control unit is arranged to control external resources of the drilling apparatus.

* * * * *